US005145360A

United States Patent [19]

Rajewski

[11] Patent Number: 5,145,360

[45] Date of Patent: Sep. 8, 1992

[54] DETONATION ARRESTOR

[76] Inventor: Robert K. Rajewski, P.O. Box 2247, Stettler, Alberta,, Canada T0C 2L0

[21] Appl. No.: 659,272

[22] Filed: Feb. 22, 1991

[30] Foreign Application Priority Data

Dec. 20, 1990 [CA] Canada ..... 2032791

[51] Int. Cl.[5] ..... F23D 14/82

[52] U.S. Cl. ..... 431/346; 48/192; 220/88.2; 222/189

[58] Field of Search ..... 431/346; 48/192; 220/88.2; 222/189

[56] References Cited

U.S. PATENT DOCUMENTS

| | | | |
|---|---|---|---|
| 58,055 | 9/1866 | Boynton | 48/192 |
| 290,559 | 12/1883 | Finnigan . | |
| 1,328,485 | 1/1920 | Berry . | |
| 1,755,624 | 4/1930 | Yount . | |
| 1,907,976 | 5/1933 | Jones | 48/192 |
| 2,068,421 | 1/1937 | Long et al. | 220/88 |
| 2,277,294 | 3/1942 | Brooks | 48/192 |
| 2,420,599 | 5/1947 | Jurs | 48/192 |
| 2,810,631 | 10/1957 | Kanenbley | 48/192 |
| 3,148,962 | 9/1964 | Dellinger et al. | 48/192 |
| 3,238,027 | 3/1966 | Dellinger | 48/192 |

FOREIGN PATENT DOCUMENTS

| | | | |
|---|---|---|---|
| 571477 | 5/1924 | France | 220/88.2 |

OTHER PUBLICATIONS

Westech drawing Inline Flame Arrester '2nd Generation' Model 55 Size 3" 125# Flange (No Date).

*Primary Examiner*—Carroll B. Dority
*Attorney, Agent, or Firm*—Anthony R. Lambert

[57] ABSTRACT

A detonation arrestor for a flare line includes a cell housing having a particulate quenching medium composed of stainless steel balls. The stainless steel balls are held in place by wire mesh and steel bars. A flame front diffusor is located on either side of the cell housing so that the detonation arrestor is symmetrical may be placed in the flare line in either direction. The flame front diffusor may be a plate or a smaller cell. A deflector ring encircles the interior of the cell housing and prevents flame fronts from flashing along the edge of the cell housing.

17 Claims, 5 Drawing Sheets

DETONATION ARRESTOR

FIELD OF INVENTION

This invention relates to detonation arrestors.

BACKGROUND OF THE INVENTION

Detonation arrestors are used in flare lines or relief lines where flammable gases are being vented or discharged for burning. The flammable gases that are being flared can sometimes be enriched with oxygen, causing a dangerous condition in which there is potential for an explosion, detonation or other flame front movement in the flare line. Such an event will be referred to as a flame front. The flame front may travel through the flare line towards the source of the flammable gases, which may be a storage tank containing flammable gases.

It is therefore highly desirable to have a device in the flare line that is capable of extinguishing such a flame front as it travels down the flare line. The device must be designed to extinguish a variety of flame fronts including a continuous burn. At the core of such a device is a part that is known as the quenching medium, and various designs have used different such media. The quenching medium is used to extinguish or in other words quench the flame.

Devices presently on the market that are used as detonation arrestors include a device having a quenching medium made of tightly wound expanded metal (aluminum mesh) made by Westech Industrial Ltd. of Sherwood Park, near Edmonton, Canada. The quenching medium includes a core made from fine expanded metal mesh that is rolled into a cylindrical shape, and has its ends cast in liquid steel. Gas passes through the mesh, and while it is useful for stopping detonations, has difficulty withstanding a continuous burn. In a continuous burn, the flame tends to stabilize on the surface of the cell and the aluminum of the expanded metal mesh tends to melt.

Earlier devices have used crimped metal ribbons as the quenching medium, for example as shown in U.S. Pat. No. 2,068,421, to Long et al. This design fails particularly when there is an air-fuel mixture on either side of the arrestor, since then the flame can pass from one side of the arrestor to the other. In a different art, tank venting, unrelated to flare lines, flame arrestors have been used that have used various types of quenching media, such as pebbles (U.S. Pat. No. 1,755,624), pellets (U.S. Pat. No. 1,328,485) and metal balls (U.S. Pat. No. 1,907,976). Other proposals have used sand and gravel. However, this technology has been considered old technology, and has not been considered adequate for todays requirements.

Other United States patents that describe flame arrestors include U.S. Pat. Nos. 290,559; 2,420,599; 2,810,631; 3,148,962 and 3,238,027.

Further, a satisfactory detonation arrestor for flare lines that is capable of withstanding a continuous burn has not to the knowledge of the inventor been previously made.

The inventor has therefore provided a detonation arrestor for connection to a flare line, the flare line having inflow and outflow ends, comprising:

a cell housing defining an interior cavity in fluid connection with the flare line;

first means attached to the cell housing for securing the detonation arrestor to the outflow end of the flare line;

a first flame front diffusor disposed in the first means in line with the flare line, having a diameter slightly greater than the flare line and spaced from the cell housing;

the cell housing including a particulate quenching medium substantially filling the interior cavity; and second means attached to the cell housing for securing the detonation arrestor to the inflow end of the flare line.

In further embodiments, the particulate quenching medium includes a plurality of heat absorbing and corrosion resistant balls, particularly stainless steel balls; the cell housing includes a deflector ring disposed around the inner circumference of the cavity in the cell housing and extending into the particulate quenching medium; the cell housing includes a filling pipe for filling the cavity with particulate quenching medium, the deflector ring being located half-way across the entry of the filling pipe into the cavity. In this latter embodiment, the first flame front diffusor may be a steel plate having a diameter greater than the diameter of the outflow line, or may include a particulate quenching medium, which itself is preferably a set of stainless steel balls.

The detonation arrestor may also include a second flame front diffusor disposed in the second means in line with the flare line and spaced from the cell housing.

In a further aspect of a detonation arrestor with stainless steel balls or other similar particulate quenching medium, the stainless steel balls are retained in place by a wire mesh supported by flat bars with their short faces abutting against the wire mesh. Cross-supports supporting the flame front diffusor may then be oriented at right angles to the flat bars for maximum strength.

In a still further embodiment, the detonation arrestor comprises:

a cell housing defining an interior cavity in fluid connection with the flare line;

first means attached to the cell housing for securing the detonation arrestor to the outflow end of the flare line;

the cell housing including a plurality of stainless steel balls substantially filling the interior cavity; and second means attached to the cell housing for securing the detonation arrestor to the inflow end of the flare line In this latter embodiment, there may be included a deflector ring disposed around the inner circumference of the cavity in the cell housing and extending into the stainless steel balls, and a filling pipe for filling the cavity with stainless steel balls, the deflector ring being located half-way across the entry of the filling pipe into the cavity.

BRIEF DESCRIPTION OF THE DRAWINGS

There will now be described preferred embodiments of the invention with reference to the drawings by way of illustration, in which like numerals denote like elements, and in which.

DETAILED DESCRIPTION OF THE PREFERRED EMBODIMENTS

Figure 1:
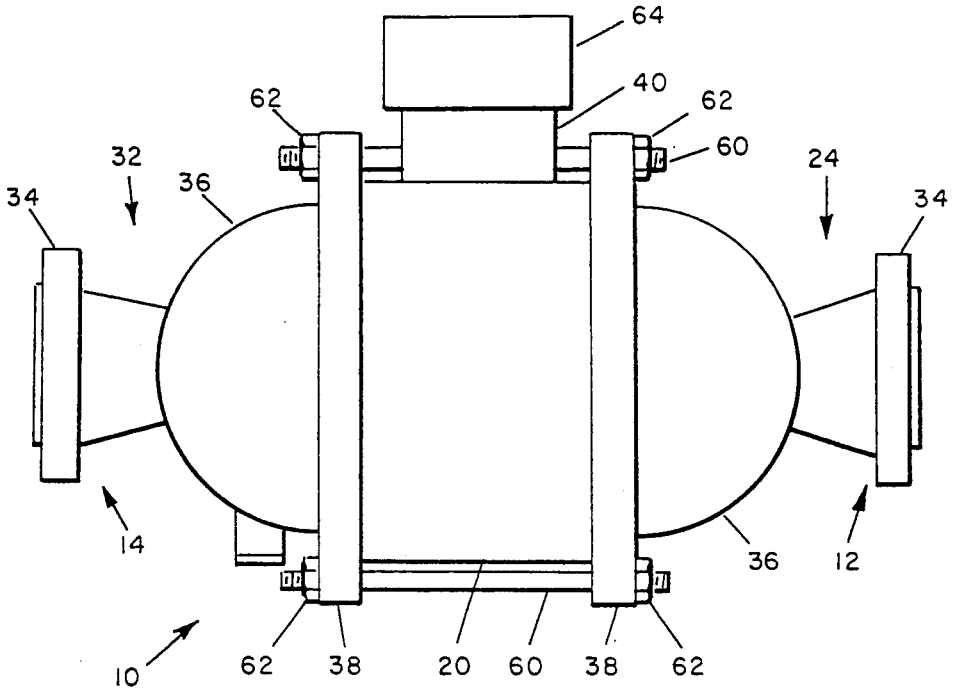
FIG. 1 is a side view of a detonation arrestor according to the invention.
Figure 2:
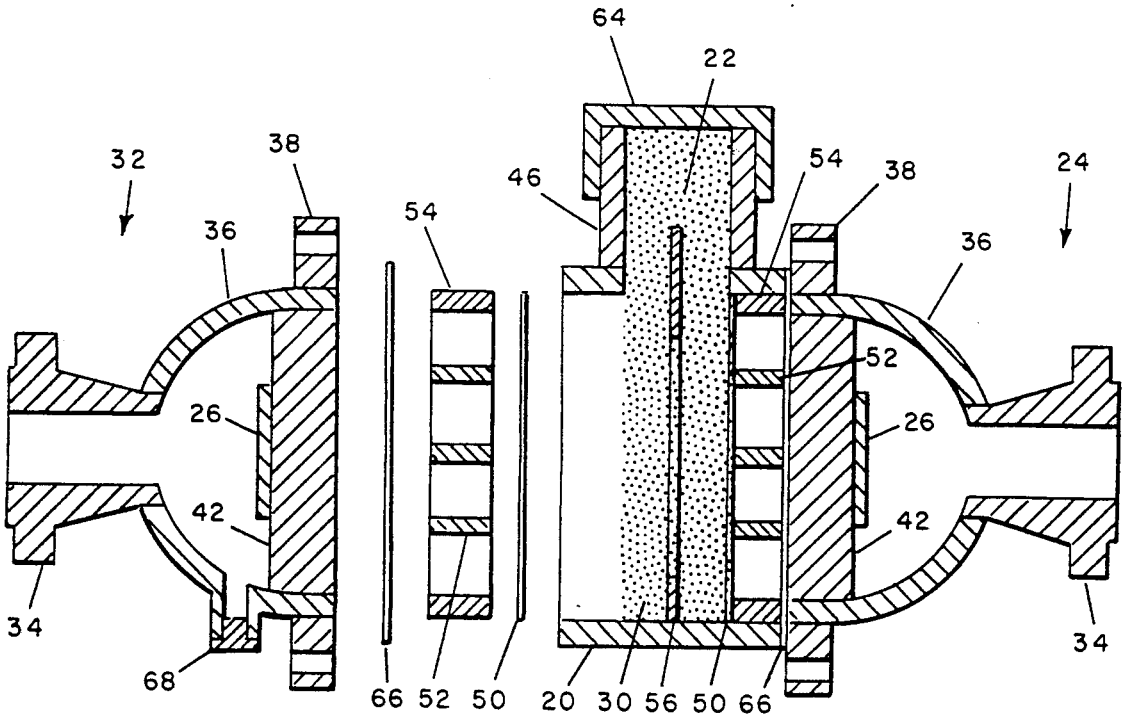
FIG. 2 is a side exploded view, partly in cross-section, of a detonation arrestor according to the invention.

Referring to FIGS. 1 and 2 there is shown a detonation arrestor generally labelled 10 according to the invention. This detonation arrestor is preferably made symmetrically so that it may be inserted into a flare line for normal operation with flow either way through it. That is, the end 12 is identical to the end 14, and only one end will be described in detail.

The detonation arrestor 10 is designed for connection to a flare line (not shown) in which the flare line has inflow and outflow ends (not shown). The major components of the detonation arrestor 10 are a cell housing 20 defining an interior cavity 22 in fluid connection with the inflow and outflow ends of the flare line. On one side of the cell housing 20 is a first means 24 attached to the cell housing 20 for securing the detonation arrestor 10 to the outflow end of the flare line. A flame front diffusor 26 is disposed in the first means 24 in line with the flare line and spaced from the cell housing 20. The cell housing 20 includes a particulate quenching medium 30 substantially filling the interior cavity 22. On the other side of the cell housing is a second means 32 attached to the cell housing 20 for securing the detonation arrestor 10 to the inflow end of the flare line.

The first means 24 includes a raised face weld neck flange 34, semi-spherical weld cap or end cap 36, and flat face slip on flange 38 into which the weld cap 36 slips. The interior of the flange 34 is a straight pipe, although the outside is shown as being conical. The preferred flame front diffusor 26 shown in FIGS. 1 and 2 is a 1¼" flat piece of steel larger in diameter than the interior diameter of the flare line, and preferably at least 1" to 1½" larger in diameter than the interior diameter of the flare line. In this case the flame front diffusor is about 5" in diameter. The flame front diffusor 26 is supported on cross-supports 42 that are secured to the weld cap 36. The flame front diffusor should be spaced from the particulate quenching medium to allow gases to circulate around it and spread out before contacting the cell housing.

The cell housing construction is shown in more detail in FIGS. 2, 3, 4 and 5. The cell housing 20 is made from seamless steel and includes a filling pipe 40 inserted in an opening on one side of the cell housing (shown here at the top) for supplying stainless steel balls 46 into the interior cavity 22. The stainless steel balls 46 are the particulate quenching medium 30 for this preferred embodiment of the detonation arrestor. The stainless steel balls 46 should substantially fill the cavity 22, and should have a size chosen to suit a particular use. Large size is preferred to allow large volume flow of gas, but small size is preferred for increased heat absorption by the steel balls. For many applications, it is believed that 3/16" eclipse balls are adequate, but ⅛" balls are preferred for additional quenching. The balls need not be round nor be made of steel, so long as they have substantially the same functional characteristics, such as heat absorption, the ability to withstand high temperatures, the ability to withstand corrosion and the ability to pack with numerous small holes between the balls. Thus for example, use of steel is believed to be inadequate because it will rapidly become corroded in the harsh $H_2S$ environment of a flare line. Aluminum is believed inadequate because it will melt in the high temperatures expected of a continuous burn. However, providing the packing of the medium left appropriate holes, it is believed that cut stainless steel wire would be sufficient. It is noted that the word "ball" as used in this patent disclosure means a particle whose stacking characteristics are similar to that of a sphere.

The cell housing size is somewhat dependent on the size of particle used. As the size of the particle decreases, the pressure drop across the detonation arrestor increases, and hence for a given flow rate of gas, the cell housing diameter must be increased. The proper dimension of the cell housing may be readily determined from the flow rate of gas in the flare line, the diameter of the flow line and the pressure drop across the detonation arrestor. For example, a 20" line may require a 48" diameter housing, with the housing being 6 to 8" thick.

Figure 3:
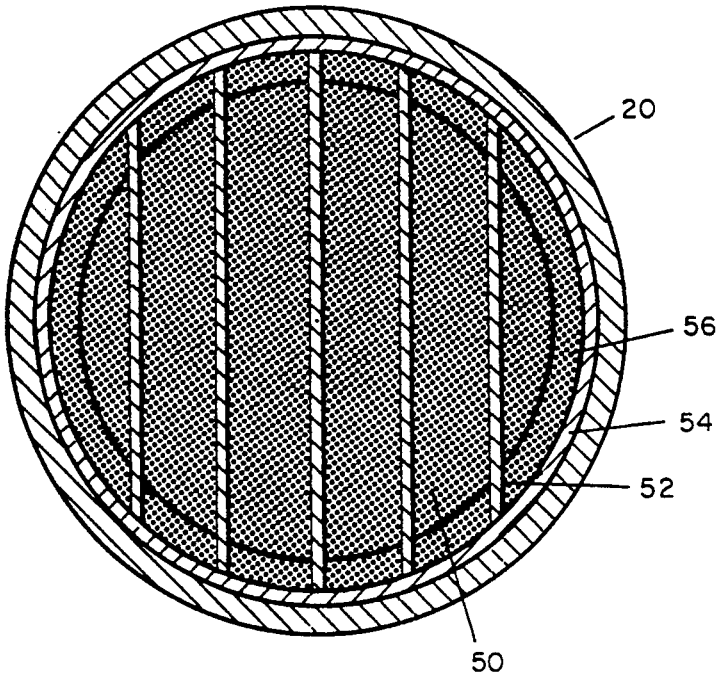
FIG. 3 is a front view of a cell assembly for the detonation arrestor shown in FIG. 1.
Figure 4:
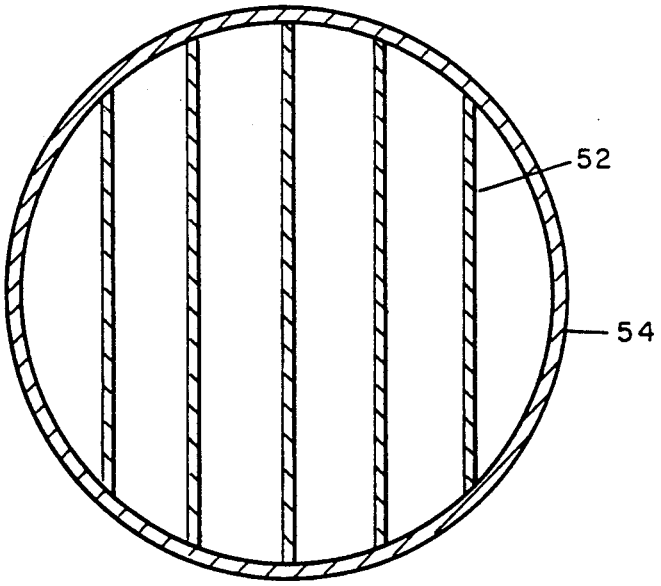
FIG. 4 is a front view of backing bars for the cell assembly of FIG. 3.
Figure 5:
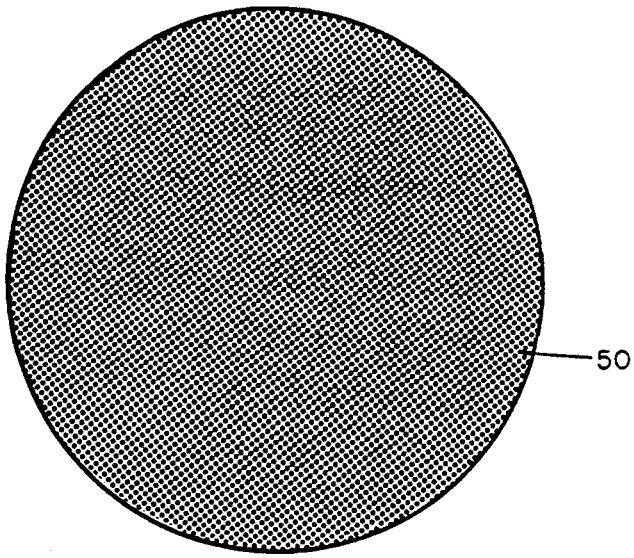
FIG. 5 is a front view of steel mesh for the cell assembly of FIG. 3.

The stainless steel balls 46 are retained in place by wire mesh 50 supported by a set of spaced apart parallel backing bars 52 which are secured (welded) to the ring 54, which in turn snugly fits in and is secured to the cell housing 20. The cross-supports 42 that retain the flame front diffusor 26 are preferably welded to the weld cap 36 at right angles to the backing bars 52, and the cross-supports 42 should abut against the backing bars 52. The wire mesh 50 should be oriented so that its wires are at 45° angles to the orientation of the backing bars and cross-supports (as shown in FIG. 3).

The backing bars and cross-supports, which are flat bars of metal, are preferably oriented with their short faces abutting against the wire mesh and flame front diffusor respectively, that is, with their intermediate dimension parallel to the direction of flow, to add to the strength of the cell assembly under detonation, and to reduce resistance to the flow of gas through the arrestor.

As shown in FIG. 2, a deflector ring 56 is provided around the inside circumference of the cell housing 20. This deflector ring 56 is preferably located half-way across the entry of the filling pipe 40 into the cavity so that on filling the cavity 22 with stainless steel balls, the stainless steel balls fall more or less equally on each side of the deflector ring 56. The deflector ring 56 should have a snug fit with the inner diameter of the cell housing 20 so that the flame front cannot pass between them. There will be an exception at the filling pipe to this snug fit, but this is not a problem as long as there are steel balls around the edge of the deflector ring 56 at the filling pipe 40 through which the flame front can pass. The deflector ring 56, like all other internal parts referred to here, should be welded in place. The deflector ring should be large enough to deflect a flame front into the stainless steel balls. For the exemplary embodiment described here, a ring sticking out 1" into the stainless steel balls has been found adequate.

Figure 6:
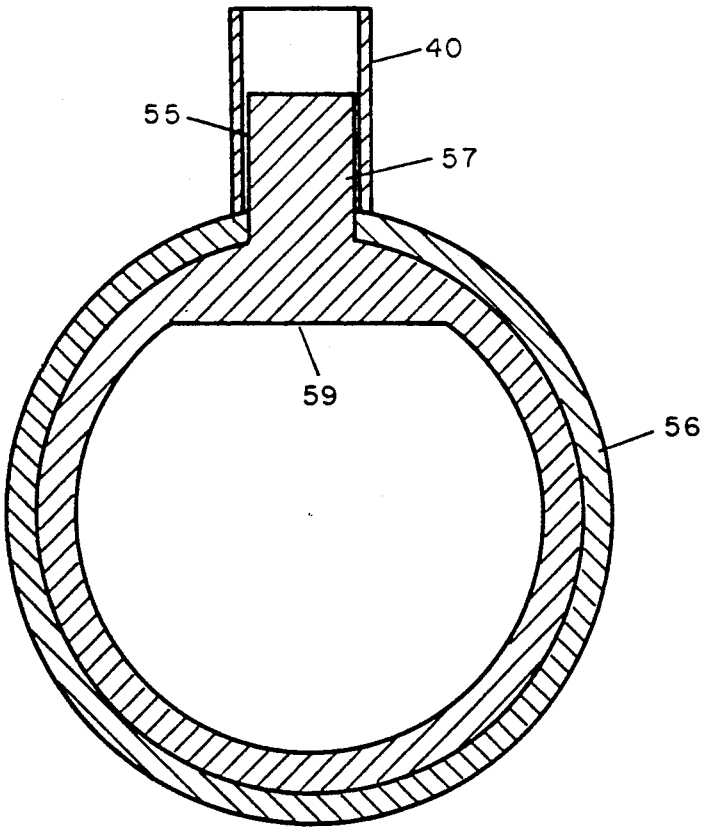
FIG. 6 is a front view of a housing for the cell assembly of FIG. 1, showing a further embodiment of a deflector ring.
Figure 7:
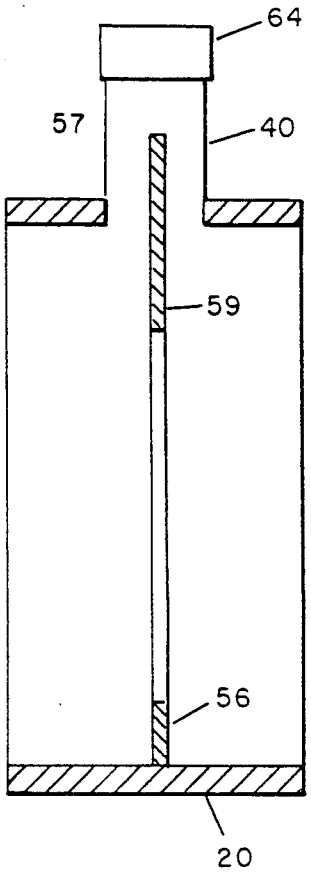
FIG. 7 is a side cross-section of the cell housing of FIG. 6.

A preferred form of the deflector ring, for added security, is shown in FIGS. 6 and 7. In each figure, the deflector ring 56 has attached to it (or forming part of it as shown here) a tongue 57 that extends into the filling pipe 40. The tongue 57 is welded to the edges of the filling pipe 40 as shown at 55 to provide a seal between the tongue 57 and the pipe 40. Below the tongue 57, the ring 56 extends about a further 1" into the interior of the cell housing and forms a crescent barrier 59.

Second means 32 attached to the cell housing 20 for securing the detonation arrestor to the inflow end of the flare line is preferably similarly constructed to the first means, including a flame front diffusor, since then the detonation arrestor works with flow both ways through it and the person doing installation need not worry which end is which.

Both flanges 38 are secured to the cell housing by studs 60 and nuts 62, with gaskets 66 between the flanges 38 and the cell housing 20. A cap 64 closes the filling pipe. A coupler and plug drain 68 is also provided for draining liquid contaminants from the cell housing 20.

Figure 8:
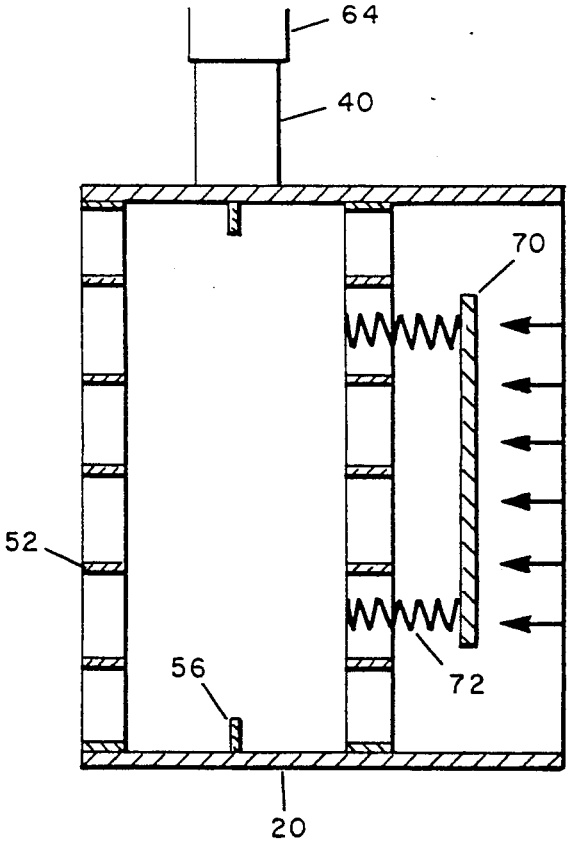
FIG. 8 is a cross-section of a cell assembly with a spring loaded secondary cell assembly secured to the cell assembly of FIG. 3

A second embodiment of the invention is shown in FIG. 8. In this case, the flame front diffusor of FIG. 1 has been replaced by a sprung loaded spreader plate 70 mounted on to the backing bars of the cell housing with springs 72. In this embodiment, the spreader plate takes energy from the impact of a flame front and converts the energy into movement. This reduces the overall amount of heat generated. After compression the springs return to the normal position. Instead of the spreader plate, a smaller cell (not shown) having the same particulate quenching medium, preferably stainless steel balls, might be used as the spreader plate. The construction of the smaller cell would be essentially the same as that of the cell 20, but would have reduced thickness in the flow direction and would not cover the entire cavity 22. As with the flat plate flame front diffusor, the spring mounted spreader plate should be spaced from the particulate quenching medium by an amount sufficient to allow gases to circulate behind the spreader plate.

Figure 9:
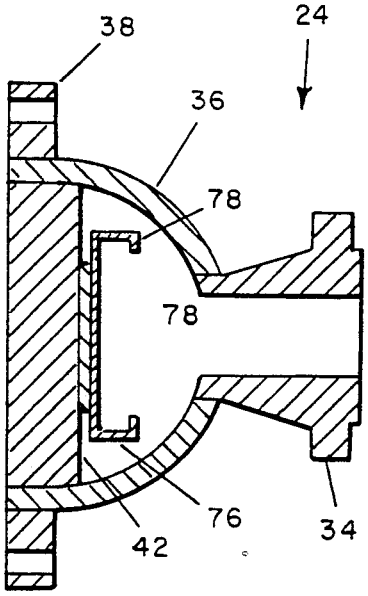
FIG. 9 is a side view of an alternative embodiment of an end cap for the detonation arrestor of FIG. 1.

A further embodiment of a flame front diffusor is shown in FIG. 9. Cap 76 is welded onto the cross-supports 42. Flanges 78 extend inward from the edges of the cap 76 to form a lip around the edge. The cap 76 dimensions are selected to exceed the diameter of the attached outflow end of the flare line.

Alternatively, the diffusor plate 26 could also include a lip, similar to the lip 76, to assist in decreasing the energy of a detonation.

The detonation arrestor is believed to work as follows. In normal operation gas flows through the flare line and into the weld cap 36 where it hits the diffusor 26. Sound waves resulting from the collision with the diffusor help spread out the incoming gas around the diffusor 26, and the gas passes from there through the particulate quenching medium and out of the cell housing, around the second diffusor, and into the outflow flare line.

When a detonation or travelling flame front occurs in the flare line, it travels against the flow of gas, from the outflow flare line to the inflow flare line, and normally is concentrated around the sides of the pipe. When the flame front reaches the flame front diffusor (it travels faster than sound and so is ahead of any sound wave), it collides with the flame front diffusor, transferring energy in the form of heat to the diffusor and then travels around the diffusor towards the particulate quenching medium. On colliding with the particulate quenching medium, preferably stainless steel balls, in the cell housing, the flame front begins a tortuous path through the particles and continues to transfer heat to the metal of the particles. As heat is transferred, if a sufficiently thick medium is chosen, the flame will be extinguished.

The deflector ring in the cell housing serves to prevent flame from flashing along the edge of the cell housing. Since the particles abut against the cell housing interior surface, rather than interleave with other particles, the area closely adjacent the interior surface of the cell housing is where the flame front may most readily move. Further, settling of the particles may occur in the cavity 22, leaving a gap at the top of the cell housing between the particles and the cell housing itself. Flame may pass along this gap, thus defeating the purpose of the detonation arrestor. In either case, the deflector ring serves to deflect the flame front into the particles. For most of the circumference of the deflector ring, the deflection is towards the interior of the cavity, and at the filling pipe is both towards the interior and into the particles in the filling pipe. The resulting deflection of the flame front allows the particles to cool and dissipate the flame.

The tongue 57 helps to prevent flame from moving around the deflector ring 56 in the filling pipe 40, and the crescent barrier 59 helps prevent settling of the particulate quenching medium from allowing a clear passage across the top of the interior of the housing just below the inside edge of the deflector ring 56.

The cap 76 helps to deflect a flame front and remove some of its heat. The lip contributes to the turbulence, and increases the probability that the flame front will have a tortuous passage through the cell assembly.

Filling of the cell housing should be done carefully to ensure that the cavity 22 is completely filled, including the filling pipe. After several detonations, the wire mesh 50 will likely have pushed into the gaps created by the backing bars 52, thus providing more room for the particles to settle. The filling pipe provides a reservoir to help offset any such settling.

The particles are poured into the cavity, and the detonation arrestor shaken to promote optimal settling of the particles. This results in a natural filling pattern with one particle falling onto three others. The resulting pattern is believed to be optimal for flame front diffusion. As the flame front passes through the particles, it separates adjacent balls, thus converting some energy to kinetic energy of the particles, and the particles heat up, thus dissipating some of the flame front energy. The heat capacity of the detonation arrestor described here, using the stainless steel balls, is believed to be so great that it can dissipate the heat of a continuous burn, and thus effectively withstand such a burn indefinitely. The barrier ring 56 is also believed to help stop flame stabilization, by eliminating a clear passage for the flame front to stabilize in.

The cavity 22 should be at least 1½" thick with steel balls of 3/16" diameter, but 4" is preferred. For larger size flare lines, increased thickness is desirable. While the combination of wire mesh and steel bars for retaining the particles is preferred, it may be possible to substitute other arrangements. For example, the inventor has tried perforated metal but has found this too hard to work with and too restricting for the flow of gas.

For maintenance when the detonation arrestor is installed in a flare line, the nuts may be taken off the studs and spreader bars used to separate the flanges from the cell housing. The cell housing may then be dropped out of the remainder of the arrestor (which remains in line).

The preferred parts used in the invention are all stainless steel or carbon steel except the gaskets and may be listed as follows:

| Item | Description |
|---|---|
| FLANGE 34 | 4" STD A105 150# RFWN |
| WELD CAP 36 | 10" STD A234 WPB |
| FLANGE 38 | 10" STD A105 150# FFSO |
| GASKETS 66 | 10" 150# GARLOCK GASKETS (TM OF GARLOCK OF CANADA LTD., of Edmonton, Alberta) |
| CELL HOUSING 20 | 12" STD A 106B SMLS |
| STEEL BALLS 46 | STAINLESS STEEL ECLIPSE |
| WIRE MESH 50 | #6 STAINLESS STEEL |
| BACKING BARS 52 | 5 3/16" × 1" FLAT 304 SS |
| CROSS SUPPORTS 42 | 2¼" × 2" FLAT A36 |
| FLAME FRONT DIFFUSOR 26 | ¼ × 5" DIA A36 CS |
| NUTS 62 | 24⅞" |
| STUDS 60 | 12⅞" |
| COUPLER AND PLUG DRAIN 68 | ¾" THRD 3000# ½ |
| FILLING PIPE 40 | 2" STD A106B SMLS |
| CAP 64 | 2" NPT THRD A105 FS |
| RING 54 | 3/16" × 1" FLAT 304 SS ROLLED TO FIT INSIDE CELL HOUSING |
| DEFLECTOR RING 56 | ⅛ × 1" A36 CS |

While preferred embodiments have been described and claimed, immaterial modifications could be made to these embodiments without departing from the invention.

I claim:

1. A detonation arrestor for connection to a flare line, the flare line having inflow and outflow ends, comprising:

a cell housing defining an interior cavity in fluid connection with the flare line;

first means attached to the cell housing for securing the detonation arrestor to the outflow end of the flare line;

a first flame front diffusor disposed in the first means in line with the flare line, having a diameter slightly greater than the flare line and spaced from the cell housing, whereby flame fronts colliding with the first flame front diffusor are deflected around the first flame front diffusor;

the cell housing including a particulate quenching medium substantially filling the interior cavity; and second means attached to the cell housing for securing the detonation arrestor to the inflow end of the flare line.

2. The detonation arrestor of claim 1 in which the particulate quenching medium includes a plurality of stainless steel particles.

3. A detonation arrestor for connection to a flare line, the flare line having inflow and outflow ends, comprising:

a cell housing defining an interior cavity in fluid connection with the flare line;

first means attached to the cell housing for securing the detonation arrestor to the outflow end of the flare line;

a first flame front diffusor disposed in the first means in line with the flare line, having a diameter slightly greater than the flare line and spaced from the cell housing;

the cell housing including a particulate quenching medium substantially filling the interior cavity;

second means attached to the cell housing for securing the detonation arrestor to the inflow end of the flare line; and a deflector ring disposed around the inner circumference of the cavity in the cell housing and extending into the particulate quenching medium.

4. The detonation arrestor of claim 3 further including a filling pipe for filling the cavity with particulate quenching medium, the deflector ring being located half-way across the entry of the filling pipe into the cavity.

5. The detonation arrestor of claim 4 further including the deflector ring extending into the filling pipe.

6. The detonation arrestor of claim 3 in which the particulate quenching medium is retained in place by a wire mesh supported by a plurality of flat bars oriented with their short faces against the wire mesh.

7. The detonation arrestor of claim 6 in which the first flame front diffusor is a steel plate having a diameter greater than the diameter of the outflow line, and the steel plate is mounted on a plurality of supports disposed at right angles to the flat bars.

8. The detonation arrestor of claim 1 in which the first flame front diffusor is a steel plate having a diameter greater than the diameter of the outflow line.

9. The detonation arrestor of claim 8 in which the particulate quenching medium is retained in place by a wire mesh supported by a plurality of flat bars oriented with their short faces against the wire mesh.

10. The detonation arrestor of claim 1 further including a second flame front diffusor disposed in the second means in line with the flare line and spaced from the cell housing, whereby flame fronts colliding with the second flame front diffusor are deflected around the second flame front diffusor.

11. A detonation arrestor for connection to a flare line, the flare line having inflow and outflow ends, comprising:

a cell housing defining an interior cavity in fluid connection with the flare line;

first means attached to the cell housing for securing the detonation arrestor to the outflow end of the flare line;

the cell housing including a plurality of stainless steel balls substantially filling the interior cavity;

second means attached to the cell housing for securing the detonation arrestor to the inflow end of the flare line; and a deflector ring disposed around the inner circumference of the cavity in the cell housing and extending into the stainless steel balls.

12. The detonation arrestor of claim 11 in which the steel balls are retained in place by a wire mesh supported by a plurality of flat bars oriented with their short faces against the wire mesh.

13. The detonation arrestor of claim 11 further including a filling pipe for filling the cavity with stainless steel balls, the deflector ring being located half-way across the entry of the filling pipe into the cavity and extending into the filling pipe.

14. The detonation arrestor of claim 11 further including a first flame front diffusor disposed in the first means in line with the flare line, having a diameter slightly greater than the flare line and spaced from the cell housing.

15. The detonation arrestor of claim 14 further including a deflector ring disposed around the inner circumference of the cavity in the cell housing and extending into the stainless steel balls.

16. The detonation arrestor of claim 15 in which the stainless steel balls are retained in place by a wire mesh supported by a plurality of flat bars oriented with their short faces against the wire mesh.

17. The detonation arrestor of claim 16 further including a filling pipe for filling the cavity with stainless steel balls, the deflector ring being located half-way across the entry of the filling pipe into the cavity.

* * * * *